United States Patent [19]

Lupton

[11] Patent Number: 4,857,177

[45] Date of Patent: Aug. 15, 1989

[54] DRY SEPARATION OF SOLIDS

[75] Inventor: John M. Lupton, Lincolnshire, England

[73] Assignee: National Research Development Corporation, London, United Kingdom

[21] Appl. No.: 149,591

[22] Filed: Jan. 28, 1988

[30] Foreign Application Priority Data

Jan. 30, 1987 [GB] United Kingdom ..... 8702166
Apr. 22, 1987 [GB] United Kingdom ..... 8709501

[51] Int. Cl.[4] ..... B07B 4/08; B07B 13/08

[52] U.S. Cl. ..... 209/466; 209/468; 209/479; 209/486; 209/493; 209/498; 209/508

[58] Field of Search ..... 209/20, 422, 423, 425, 209/427, 466–469, 471, 477–480, 474, 475, 485, 486, 488, 490, 493, 497–499, 502–505, 508, 473

[56] References Cited

U.S. PATENT DOCUMENTS

| | | | |
|---|---|---|---|
| 1,801,195 | 4/1931 | Fraser | 209/474 |
| 2.007,190 | 7/1935 | Fraser | 209/474 |
| 2,303,367 | 12/1942 | Kendall et al. | 209/466 X |
| 2,910,179 | 10/1959 | Svensson | 209/423 X |
| 3,444,996 | 5/1969 | Douglas et al. . | |
| 4,035,288 | 7/1977 | Gibert et al. | 209/466 |

FOREIGN PATENT DOCUMENTS

| | | | |
|---|---|---|---|
| 2848474 | 5/1979 | Fed. Rep. of Germany . | |
| 3520570 | 12/1986 | Fed. Rep. of Germany | 209/486 |
| 0528091 | 11/1921 | France | 209/466 |
| 0898197 | 4/1945 | France | 209/422 |
| 0946480 | 1/1964 | United Kingdom | 209/470 |
| 1085810 | 10/1967 | United Kingdom . | |
| 1178235 | 1/1970 | United Kingdom . | |

*Primary Examiner*—Robert B. Reeves
*Assistant Examiner*—Edward M. Wacyra
*Attorney, Agent, or Firm*—Cushman, Darby & Cushman

[57] ABSTRACT

Mixed scrap metal pieces 6 are sorted in a fluidised hindered settler containing sand, through which the pieces settle at a differential rate. The sand is fluidised by air from 20 and vibration-driven around a circular trough 2. A depthwise partition 14*a* sorts the pieces according to settling rate, whereafter they are removed up separate ramps 14 and 16. The sand is levelled preparatory to receiving the pieces 6, and only afterwards is it fluidised.

9 Claims, 1 Drawing Sheet

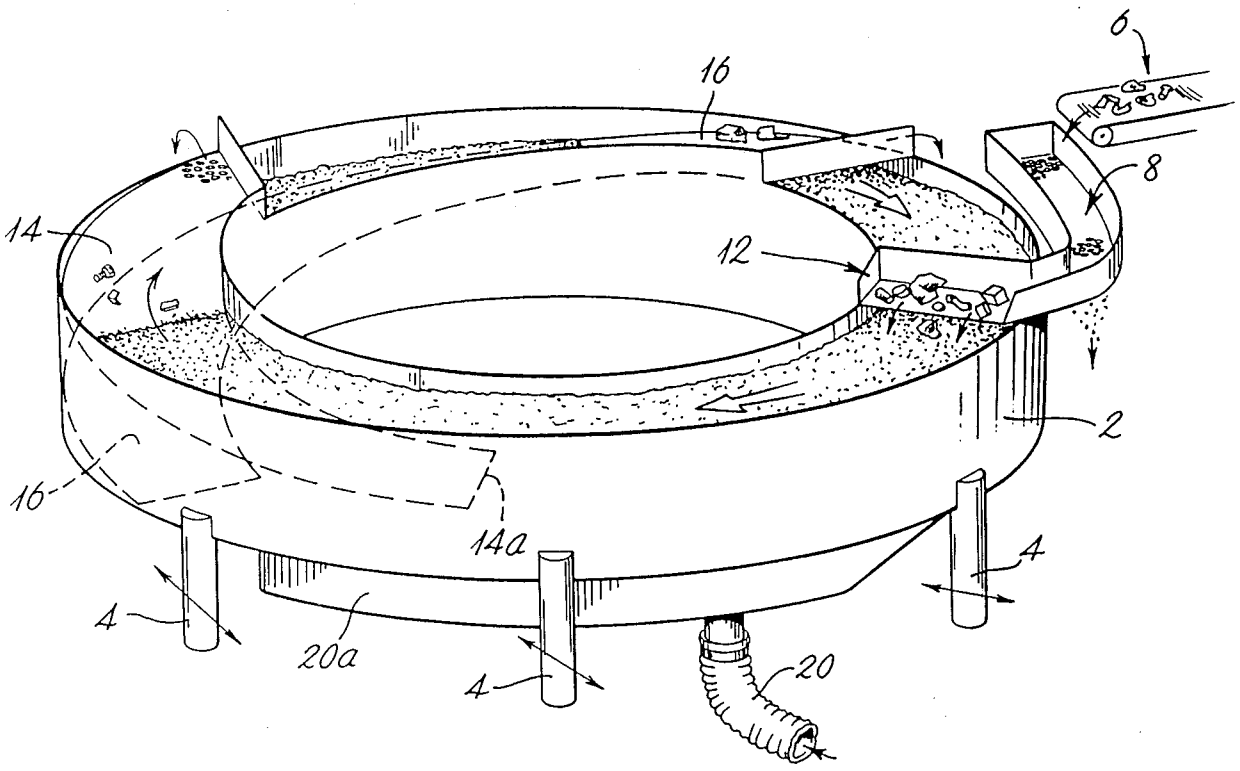
6
8
2
4
20
16
12
14a
4
20a
4
14
16

DRY SEPARATION OF SOLIDS

The present invention relates to a method and apparatus for dry separation of solids such as mineral ores, waste material or scrap metal.

Known dry media separators are disclosed in British Patent Nos. 1085810 and 1178235, in both of which a mixture of materials of at least two different densities is introduced into a bed having a dry flotation medium which is vibrated and air-fluidised. The principle of operation is that heavier particles of material sink to the bottom of the medium and lighter particles of material "float" towards the top of the medium. The materials are effectively separated by having at one end of the flotation bed a weir over which only the lighter material flows and a ramp and inverted weir at the other end up which the heavier material flows. The apparatus is not found to be very efficient for a number of reasons. In particular the lighter material tends to circulate round within the bed and is not efficiently discharged. The lighter material may also be discharged with the heavier material particularly if the separator is heavily loaded, considerably lowering the value of the sorted material.

It is an object of the present invention to provide a more efficient dry media separator.

According to the present invention there is provided a method of dry separation of solids, comprising: vibration-driving a particulate material, finer than the solids, to flow round a defined endless generally horizontal path; fluidising the material for a length of the path; adding the solids to the top of the flowing material; and depthwise partitioning the flowing material downstream of the solids-addition point and within the fluidised length, whereby to separate the solids which have not settled beyond the depth of the partition from those which settled faster.

The invention also provides a solids separator, comprising a trough defining an endless generally horizontal path, the trough having an air-permeable base over a length of the path; a distributor for solids onto the trough; and a depthwise partition in said trough at a point on said length. Preferably means are provided to vibrate the separator with simultaneous horizontal and vertical components. The separator in use contains a particulate material as an entraining medium, and preferably the partition is perforated (to retain partitioned solids but to pass any entraining medium). An air supply upwardly through said base is in use present, to fluidise the medium.

Preferably the solids-addition point (the distributor) is upstream of the fluidised length, which preferably starts with an onset zone over which fluidisation progressively increases.

Preferably the defined path is rotary.

Preferably the rotary path is circular and the material and medium are constrained to move in the defined circular path by upstanding wall members.

Preferably the medium is fluidised over only a length of the rotary path.

The slower-settling material is preferably extracted by means of the partition, which is in the form of a first ramp positioned along the rotary path at a position downstream from the commencement of the fluidised portion of the rotary path, and the faster-settling material is preferably extracted by means of a second ramp starting lower than the partition and preferably positioned along the rotary path at a position downstream from the first ramp. Preferably the second ramp is positioned after the end of the fluidised length. Each ramp is preferably perforated such as to retain partitioned solids but to pass the particulate material, which can thereby continue flowing along said defined path.

The present invention will now be described by way of example with reference to the accompanying drawing, which shows a dry separation apparatus according to the present invention in diagrammatic perspective.

The apparatus, which as will be seen can be considered as a flowing media jigging separator, has a horizontal annular circular trough 2 which is vibrated through spring-supported mounts 4 with a motion which is clockwise-and-up/anticlockwise-and-down. Merely as a guide to indicate the general scale of one operable apparatus according to the invention, the diameter is 2 m. The motion derives from eccentric cams or, preferably, two exciter units attached to diametrically opposite mounts 4 vibrating with opposed horizontal (i.e. net rotational) and in-phase vertical components, giving a reciprocating screw-twist rising and falling at for example a resultant 45° to the horizontal.

The frequency and amplitude of vibration of the exciter units are selected according to the size and intended throughput of the separator apparatus but again merely as a guide could be of the order of 50 Hz and 3 mm.

The apparatus is fed by a chute 6 leading to a perforated track 8 adjoining part of the trough 2 at a higher level. The track 8 feeds a distributor 12 for discharging feed at a single angular location into the trough 2. Underneath the distributor 12 is an adjustable horizontal radial straight-edge (not shown) for levelling the contents of the trough 2.

About a radian clockwise from the distributor 12, a helical upwards perforated ramp 14 occupies the trough, starting with a strictly radial and horizontal splitter edge **14*a***. The edge is about half-way down the depth of the trough; its exact height and distance from the distributor are determined by trial and error.

A second perforated and upward helical ramp 16 occupies the trough, starting at its base, at a (non-critical) later clockwise position. Both ramps 14 and 16 rise to the top of the trough and discharge their respective streams of material over the side to different collectors.

The base of the trough, from a point somewhat clockwise of the distributor 12 to a point somewhat clockwise of the splitter edge **14*a*, is an air-permeable membrane, the rest of the base being solid. The membrane passes air upwardly from a manifold 20*a* fed by a compressed air line 20**. At the anticlockwise end of the membrane is a transition zone whereby the onset of fluidisation (to be described) is graduated over an area.

The trough is filled to a level well above the splitter edge **14*a* but below the brim with a dry particulate medium which is fine in comparison with the solids to be separated and which, unlike the solids, can pass through the perforated ramps 14 and 16**. Sand is suitable, the particle size and type being selected by trial and error to suit the specific separation.

The operational sequence of the separation apparatus is as follows.

Typical solids to be separated comprise pieces of various materials obtained, for example, by crushing and fragmentising scrap cars, machines, 'white goods' and television sets. Ferrous metals are removed magnetically, leaving dust or dirt particles; rubber, plastic and glass; and pieces of light metals (magnesium, aluminium) and denser metals (zinc, brass).

The solids are screened to exclude oversize chunks and then fed by the chute 6 to the track 8. The exciter units are activated and their vibratory action causes the material to move in a clockwise direction along the perforated track 8, where undersize solids are lost, shaken through the perforations. As a guide, the perforations may lose solids of volumes up to 100 times the volume of a grain of sand. The remaining solids drop off the lip of the distributor 12 into the trough 2. The sand here has been levelled by the straight-edge and is not fluidised.

Air through the line 20 fluidises the sand in the arc above the membrane, to a modest bed expansion (a few tens of percent) starting gradually over an area at the anticlockwise end. The vibratory action simultaneously causes all the sand in the trough 2 to advance slowly clockwise. The solids are entrained in this advance, and the very lightest solids "float" on the surface of the fluidised and advancing sand, while the remaining solids sink at varying rates, according to a phenomenon known as hindered settling induced by the combination of vertical (fluidised and vibrated) and horizontal (vibrated) motions. Thus by the time that these solids have been conveyed the radian or so distance to the splitter edge 14*a*, some of them will have settled to its depth or deeper, while the rest will have settled less deep.

This rest therefore moves up the ramp 14 (which is also being vibrated) and is discharged over the side, for example into an annular picking tray (not shown) round which those solids move, allowing unwanted material to be hand picked therefrom. The ramp 14 being perforated, the sand falls through back into the trough 2 and thereby continues on round the trough to be used again in the separation process.

Meanwhile, the faster-settling solids are conveyed under the splitter edge 14*a* and along or near the base of the trough 2 until they meet the second ramp 16 the end of which is at or close to the bottom of the trough. These solids move up the ramp 16 which is perforated to allow the sand to be shaken through, leaving these solids to proceed up the ramp to an outlet chute (not shown). That chute may lead to a picking tray (e.g. a further section of the said annular picking tray, for hand picking), and thence to a collecting hopper. The bottom of this ramp 16 is in the non-fluidised section of the trough.

The sand flows on round the trough 2 as shown by the hollow arrows to receive a fresh load of solids from 12 in its turn.

For a more discriminating separation, two apparati can operate in series, the second receiving as feed one of the exiting solids streams of the first, and the two apparati operating with appropriately differning parameters such as splitter edge depth or garde of sand.

I claim:

1. A solids separator, comprising a trough defining an endless generally horizontal path the trough having a base and in use containing a particulate material as an entraining medium; a distributor for solids onto the trough; and a depthwise partition in said trough, characterized in that the base is air-permeable for only a portion of the length of the trough, the partition being situated over said portion and the distributor being situated off said portion and there are means to vibrate the separator with simultaneous horizontal and vertical components.

2. A solids separator according to claim 1 , wherein the air-permeable portion of the base, at its end facing the distributor, has an onset zone over which the air-permeability progressively increases.

3. A solids separator according to claim 1 or 2 , further comprising means directing an air stream upwardly through said base, to fluidise the medium.

4. A solids separator according to claim 1 or 2 wherein the endless path is rotary.

5. A solids separator according to claim 4, wherein the rotary path is circular and the material and medium are constrained to move in the defined circular path by upstanding wall members.

6. A solids separator according to claim 1 or 2 further comprising means for levelling the entraining medium before it reaches the distributor.

7. A solids separator according to claim 1 or 2 , wherein the partition is in the form of a first ramp starting over the said air-permeable portion of the base.

8. A solids separator according to claim 7, further comprising a second ramp starting lower than the first ramp rising in the same sense from a position beyond that end of the air-permeable portion distant from the distributor.

9. A solids separator according to claim 7 , wherein the ramp is perforated such as to retain partitioned solids but to pass the particulate material, which can thereby continue flowing along said defined path.

* * * * *